US012655544B2

(12) United States Patent
Stündl et al.

(10) Patent No.: US 12,655,544 B2
(45) Date of Patent: Jun. 16, 2026

(54) METHOD FOR PRODUCING A CRIMPED COMPOSITE THREAD

(71) Applicant: Oerlikon Textile GmbH & Co. KG, Remscheid (DE)

(72) Inventors: Mathias Stündl, Rellingen (DE); Kirsten Prehn, Norderstedt (DE); Friedrich Lennemann, Neumünster (DE)

(73) Assignee: Oerlikon Textile GmbH & Co. KG, Remscheid (DE)

( * ) Notice: Subject to any disclaimer, the term of this patent is extended or adjusted under 35 U.S.C. 154(b) by 90 days.

(21) Appl. No.: 18/678,879

(22) Filed: May 30, 2024

(65) Prior Publication Data

US 2024/0410093 A1 Dec. 12, 2024

(30) Foreign Application Priority Data

Jun. 7, 2023 (DE) ..... 10 2023 002 303.5

(51) Int. Cl.

| | |
|---|---|
| ***D02G 1/00*** | (2006.01) |
| ***D01D 5/08*** | (2006.01) |
| ***D01D 5/22*** | (2006.01) |
| ***D01D 5/253*** | (2006.01) |
| ***D01D 5/32*** | (2006.01) |
| ***D02G 1/12*** | (2006.01) |
| ***D02G 3/04*** | (2006.01) |

(52) U.S. Cl.

CPC ..... *D02G 1/004* (2013.01); *D01D 5/082* (2013.01); *D01D 5/22* (2013.01); *D01D 5/253* (2013.01); *D01D 5/32* (2013.01); *D02G 3/045* (2013.01)

(58) Field of Classification Search

CPC ..... D01D 5/22; D01D 5/253; D01D 5/32; D02G 1/00; D02G 1/004; D02G 1/12

USPC ..... 264/168, 172.12, 172.14; 425/66; 28/247

See application file for complete search history.

(56) References Cited

U.S. PATENT DOCUMENTS

| | | | | |
|---|---|---|---|---|
| 3,671,379 | A * | 6/1972 | Evans et al. | D01F 8/14 264/172.12 X |
| 4,057,880 | A * | 11/1977 | Matthews | D04B 1/26 28/154 |
| 5,863,478 | A * | 1/1999 | Ruf | D01F 2/00 264/210.8 |
| 2020/0032429 | A1 * | 1/2020 | Steffen | D02G 1/004 |

FOREIGN PATENT DOCUMENTS

| | | |
|---|---|---|
| EP | 0485871 | 5/1992 |
| EP | 1184494 | 3/2002 |
| WO | 20210118985 | 6/2021 |

* cited by examiner

*Primary Examiner* — Leo B Tentoni
(74) *Attorney, Agent, or Firm* — BainwoodHuang

(57) ABSTRACT

The invention relates to a method and to a device for producing a crimped composite thread. The crimped composite thread includes a first polymer melt and a second polymer melt. The first polymer melt and the second polymer melt are arranged next to one another, in particular side-by-side, in portions in such a way that a composite thread is formed. The first polymer melt and the second polymer melt each have a different material property so that self-crimping of the composite thread is initiated by means of an active crimping initiation. Additionally, there is a system for producing a crimped composite thread from a bulk continuous filament yarn for carpet yarn using the method and the device.

15 Claims, 8 Drawing Sheets

METHOD FOR PRODUCING A CRIMPED COMPOSITE THREAD

Figure 1:
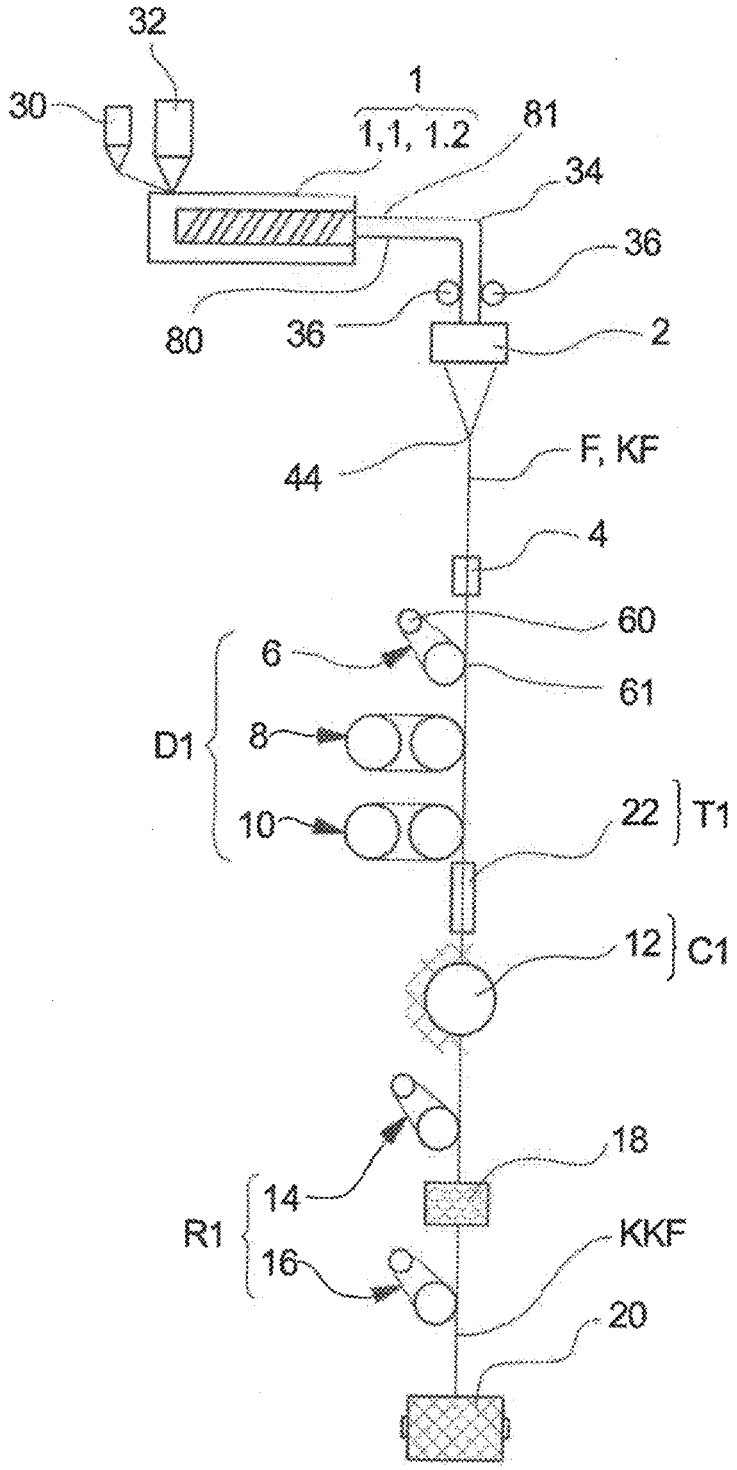

The invention relates to a method and to a device for producing a crimped composite thread, wherein the crimped composite thread comprises a first polymer melt and a second polymer melt.

One example of a crimped thread is a texturised synthetic thread for carpet yarn (BCF yarn—Bulk Continuous Filament Yarn).

A crimp in the thread can be formed mechanically by active compression, by a thermal input which causes shrinkage, or by self-crimping.

EP1184494B1 describes a texturising nozzle for mechanically compressing or crimping a BCF yarn. Using the texturising nozzle, a crimp in the BCF yarn can be mechanically formed by compression in that the BCF yarn is compressed to form a plug in the texturising nozzle, as a result of which the filaments of the yarn are kinked, this leading to crimping.

EP0485871B1 describes a method and a device in which crimping of the multicoloured synthetic threads that are compressed to form a plug is thermally formed by impinging the latter with a flow of a heated fluid, this leading to a thermally initiated shrinkage of the threads, which causes crimping.

WO 2021/118985 A1 describes a carpet having a bi-component thread which comprises one component of polyethylene terephthalate homopolymer, or polyethylene terephthalate copolymer, and a second component of polytrimethylene terephthalate polymer, or a mixture of polytrimethylene terephthalate and polyethylene terephthalate homopolymer or polyethylene terephthalate copolymer, whereby the bi-component thread by virtue of the different shrinkage is self-bulking as soon as the bi-component thread is extruded from the melt-spinning device and shrinking begins.

As already outlined above, crimping or bulking of a BCF thread, or of a multicoloured synthetic thread, can be generated by mechanically or thermally acting means, or the BCF thread is a bi-component thread which comprises polymers that cause self-bulking as a result of the different shrinkage of the respective polymer.

The crimping, or the shrinkage, is initiated in that either the thread is impinged with an external action by mechanically or thermally acting means, or the thread has a combination of polymers which can lead to self-crimping without self-crimping having to be activated by any external action.

Further processing, such as tufting, for example, of the bi-component thread is difficult when the latter is excessively shrunk and/or crimped. Tufting is understood to mean a production method of textile floor coverings in which a bi-component thread is incorporated into a woven backing fabric or into a spun-bonded fabric. If the bi-component thread is excessively crimped, tufting has to be adapted to the crimp present.

Excessive shrinkage and/or crimping substantially compromise/compromises the further processing and renders further processing more complex and expensive.

Excessive shrinkage can occur in mechanical crimping as well as in thermal crimping.

In the case of self-crimping it is disadvantageous that self-crimping can start at a point in time in the production process at which self-crimping should specifically not take place, such as when the synthetic filaments are converged at a so-called convergence point.

Moreover, in the case of bi-component threads a large quantity of the respective polymer melt is required for producing a bi-component thread by the above-mentioned crimping methods in order to achieve the desired crimping quality.

It is thus an object of the invention to provide a method and a device for producing a crimped composite thread, by way of which the abovementioned disadvantages can be avoided or at least mitigated.

It is additionally an object of the invention to provide a system for producing a crimped composite thread from a BCF yarn for carpet yarn, by way of which the abovementioned disadvantages can be avoided or at least mitigated.

In terms of the method, this object is achieved according to the invention by a method having the features according to claim 1.

Provided according to one aspect of the invention is a method for producing a crimped composite thread, wherein the crimped composite thread has a plurality of composite filaments from a first polymer melt and a second polymer melt, wherein the first and the second polymer melt are arranged next to one another, in particular side-by-side, in portions in such a way that a composite thread is formed. The first polymer melt and the second polymer melt each have a different material property so that self-crimping of the composite thread can be initiated open-loop and/or closed-loop controlled by an active crimping initiation at a predetermined point in the method.

A composite filament is understood to mean in particular a synthetic filament of infinite length, which has at least a first and a second polymer melt and is extruded via capillaries of a melt-spinning installation. Each capillary of the melt-spinning installation extrudes one composite filament. The number of capillaries of the melt-spinning installation determines the number of composite filaments.

A composite thread is understood herein to mean a composite thread which has a plurality of combined composite filaments which each have a first polymer melt and a second polymer melt, as well as a multi-composite thread which has a third polymer melt.

It is essential herein that the composite filaments that form the composite thread have at least two different or identical polymers which at least have different material properties such as, for example, a different viscosity. The different viscosities of the polymers require self-crimping of the composite thread by means of an active crimping initiation, such as by an external mechanical and/or thermal activation, for example.

Not only can self-crimping be activated, and the point where self-crimping is to take place be determined, by the variable of the mechanical and/or thermal activation, but also the degree and the extent of self-crimping.

This has the advantage that self-crimping can be initiated at a predetermined point in the method.

Moreover, the degree of self-crimping can be controlled, for example in that the variable of the initiating threshold value of the crimping initiation is open-loop and/or closed-loop controlled. In the case of closed-loop control, sensors that monitor the degree of self-crimping are also provided. The results of the sensors can then be used for closed-loop controlling the variable of the initiating threshold value in such a way that substantially constant self-crimping can be achieved at the desired quality.

The invention comprises a production method for an intensely crimping composite thread, in particular a BCF bi-component thread, from at least a first polymer and a second polymer, or a plurality of polymers.

The polymer combination is chosen in such a way that self-crimping of the composite thread by tension and/or temperature can be initiated by means of a mechanical and/or thermal crimping initiation. This can be achieved, for example, in that the composite thread is drafted to the extent that self-crimping is actively initiated.

Besides the mechanical initiation of self-crimping, the latter can also be thermally initiated by way of temperature.

In both cases, self-crimping is initiated by an additional step which has to be actively carried out. Self-crimping would otherwise not take place without this step.

According to a particular design embodiment of the method, the active crimping initiation of self-crimping is mechanically initiated by applying a predetermined tension variable to the composite thread, wherein a predetermined tensile stress is applied to the composite thread.

In order to initiate self-crimping, which is finer and of better quality in comparison to compression-crimping, a mechanical crimping initiation is preferably applied to the composite thread, for example in that the composite thread emanating from the cooling drum is routed via an additional drafting unit, and a predetermined tensile stress with a predetermined threshold value is applied to the composite thread.

Alternatively or additionally to the mechanical initiation of the bi-component thread crimping, the bi-component thread crimping can also be thermally activated.

In a further, particularly preferred, design embodiment of the method, the active crimping initiation of self-crimping is initiated thermally by heating, whereby a predetermined temperature variable is applied to the composite thread.

In order to initiate self-crimping, which is finer and of better quality in comparison to compression-crimping, a thermal crimping initiation is preferably applied to the composite thread, for example in that the composite thread is heated on the cooling drum by way of a heating installation. The heating then initiates self-crimping of the composite thread so as to form a crimped composite thread.

For this purpose, once the plug has cooled on the cooling drum, said plug can once again be heated at a temperature which is correspondingly lower than a compression-texturising temperature during compression-texturising.

Alternatively, heating by means of the heating installation can also take place between the cooling drum and a drafting unit.

In a particularly preferred design embodiment of the method, the composite thread is configured to be trilobal in shape, and/or each trilobal portion has in each case a first, a second and/or a third polymer melt.

A trilobal cross section of the composite thread is understood to mean a cross section with three lobes, similar to a clover leaf. Cross-sectional shape portions of the trilobal cross section are preferably designed in such a way that at least two of the three cross-sectional shape portions have in each case a first polymer and a second polymer with different self-crimping properties.

In a particularly preferred design embodiment of the method, the first polymer melt has a different viscosity than the second polymer melt.

It is important for activatable self-crimping that the first polymer melt and the second polymer melt each have different viscosities. Owing to the different viscosities, the first and the second polymer melt are supplied to the melt-spinning device at different flow rates, for example by pumps.

In a further, particularly preferred, design embodiment of the method, the tensile stress on the composite thread is initiated by means of a drafting unit, wherein a tensile stress, in particular in the range from 1 to 4.5 cN/dtex, which reaches a predetermined threshold value that initiates self-crimping is applied to the composite thread by means of the drafting unit, wherein the variable of the threshold value determines the degree of self-crimping.

A drafting unit which has a least one godet and/or an idler roller about which the composite thread is able to be wound at least in portions is preferably provided for initiating self-crimping. The godet is operated at a higher rotating speed than the godets disposed upstream thereof in the thread running direction, so that tensile stress is able to be generated in the composite thread. If the tensile stress exceeds a specific threshold value, self-crimping of the composite thread is activated and initiated.

The idler roller is preferably without a drive and serves for guiding the composite thread.

The godet is preferably not heated, but may also be heated. The godet can be heated in such a way that thermal self-crimping is also able to be initiated by the heating effect of the godet.

Alternatively, a thread brake which is positioned behind the cooling drum can also be used.

Alternatively, crimping can also be initiated by an additional godet pair which is positioned in front of compression-texturising. The godet pair has a first godet and a second godet which can both be heatable and may have a dedicated drive which is able to be open-loop and/or closed-loop controlled. The godets preferably have identical diameters.

According to a particular design embodiment of the method, the tensile stress which, for initiating self-crimping, is applied to the composite thread by means of a drafting unit is greater than a tension which is applied to the composite thread for drafting by a drafting unit.

The drafting units for drafting the composite thread are operated at a lower rotating speed than the drafting units for initiating self-crimping. In this way, a different tensile stress also acts on the composite thread.

In a particularly preferred design embodiment of the method, self-crimping of the composite thread is initiated by means of heating by means of a heating installation, wherein self-crimping is initiated at a predetermined temperature variable in the composite thread, in particular at temperature variable in the range from 100 to 150° C., wherein the variable of the temperature determines the degree of self-crimping.

Self-crimping of the composite thread can also be activated by a thermal crimping initiation, in particular once compression-texturising has taken place. Provided for this purpose is an additional heating installation which can be positioned at the cooling drum, for example, or downstream of the cooling drum in the thread running direction.

The preferred temperature for initiating self-crimping is a temperature variable in the range from 100 to 150° C., to which the composite thread is to be heated. The heating installation can be open-loop and/or closed-loop controlled.

Further temperature controlling in the method takes place according to the polymers and can take place at the same temperature level as is normally used in compression-texturising down to room temperature.

In a particularly preferred design embodiment of the method, the first and the second polymer melt are extruded in a melt-spinning device and are spun so as to for a plurality of composite filaments which are cooled so as to form a partially crystalline structure and are converged at a convergence point so as to form a composite thread which is drafted in a first drafting device so as to form a preliminary drafted composite thread, wherein self-crimping in the composite thread is initiated in subsequent steps by applying a predetermined mechanical tension variable and/or a predetermined temperature variable so that a crimped composite thread is formed.

The plurality of composite filaments are combined at a convergence point, so as to form a composite thread.

According to a particular design embodiment of the method, the active crimping initiation of self-crimping of the composite thread is initiated before and/or after compression-crimping, wherein the composite thread during compression-crimping is compressed in the thread during direction in a compression-crimping installation, wherein the compression of the composite thread initiates crimping.

In terms of the device, this object is achieved according to the invention by a device having the features according to claim 11.

Provided according to one aspect of the invention is a device for producing a crimped composite thread, which is specified for carrying out the method according to at least one of the preceding design embodiments, wherein the device has an installation for the active initiation of self-crimping of the composite thread.

According to a particular design embodiment of the device, the installation for the active initiation of self-crimping has a drafting device for generating tensile stress in the composite thread, and/or has a heating installation for generating an increase in temperature in the composite thread.

In terms of the system, this object is achieved by a system having the features according to claim 13.

Provided according to one aspect of the invention is a system for producing a crimped composite thread from a BCF yarn for carpet yarn, which is specified for carrying out the method according to at least one of the preceding design embodiments, and/or has at least one of the devices according to at least one of the preceding design embodiments.

The device according to the invention will be explained in more detail hereunder by means of several exemplary embodiments of the device according to the invention and of the method according to the invention, with reference to the appended figures.

Figure 2:
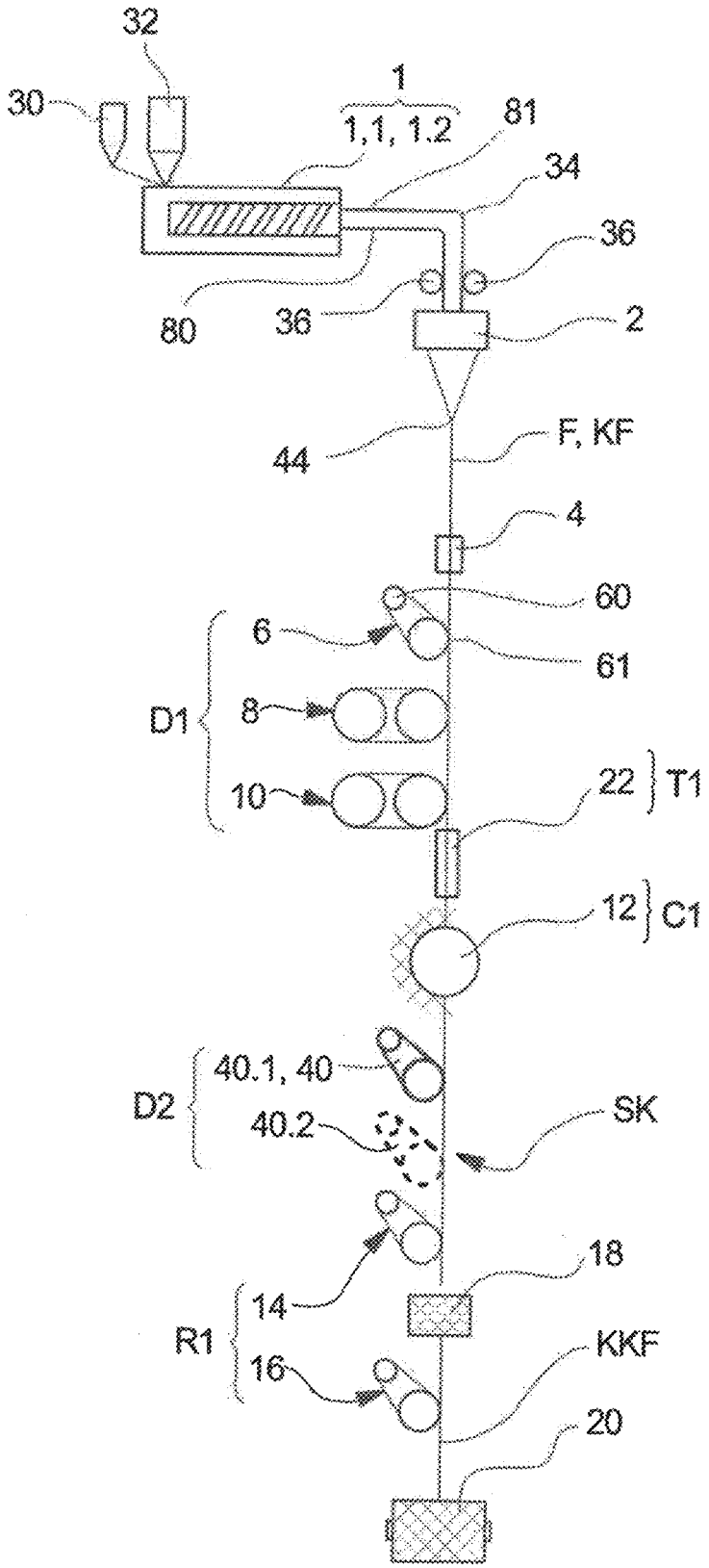
Figure 3:
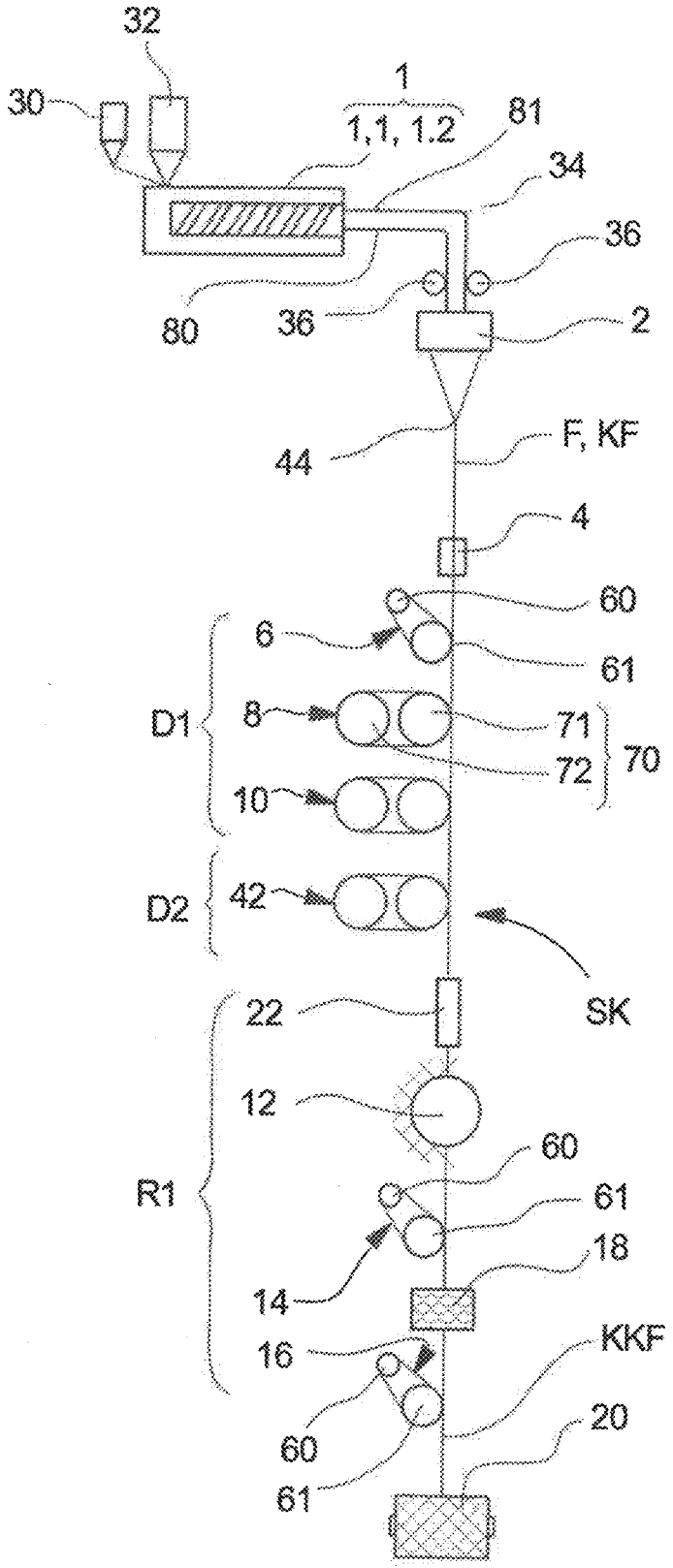
Figure 4:
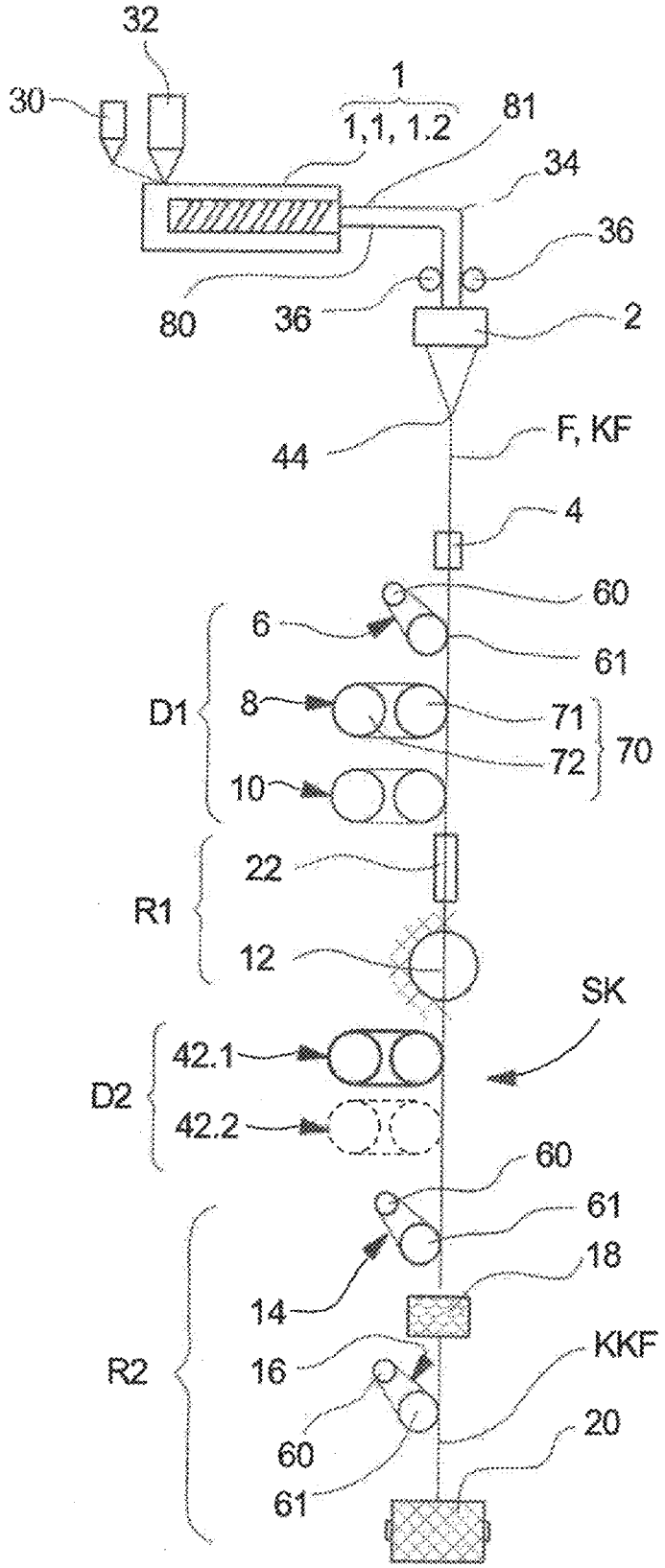
Figure 5:
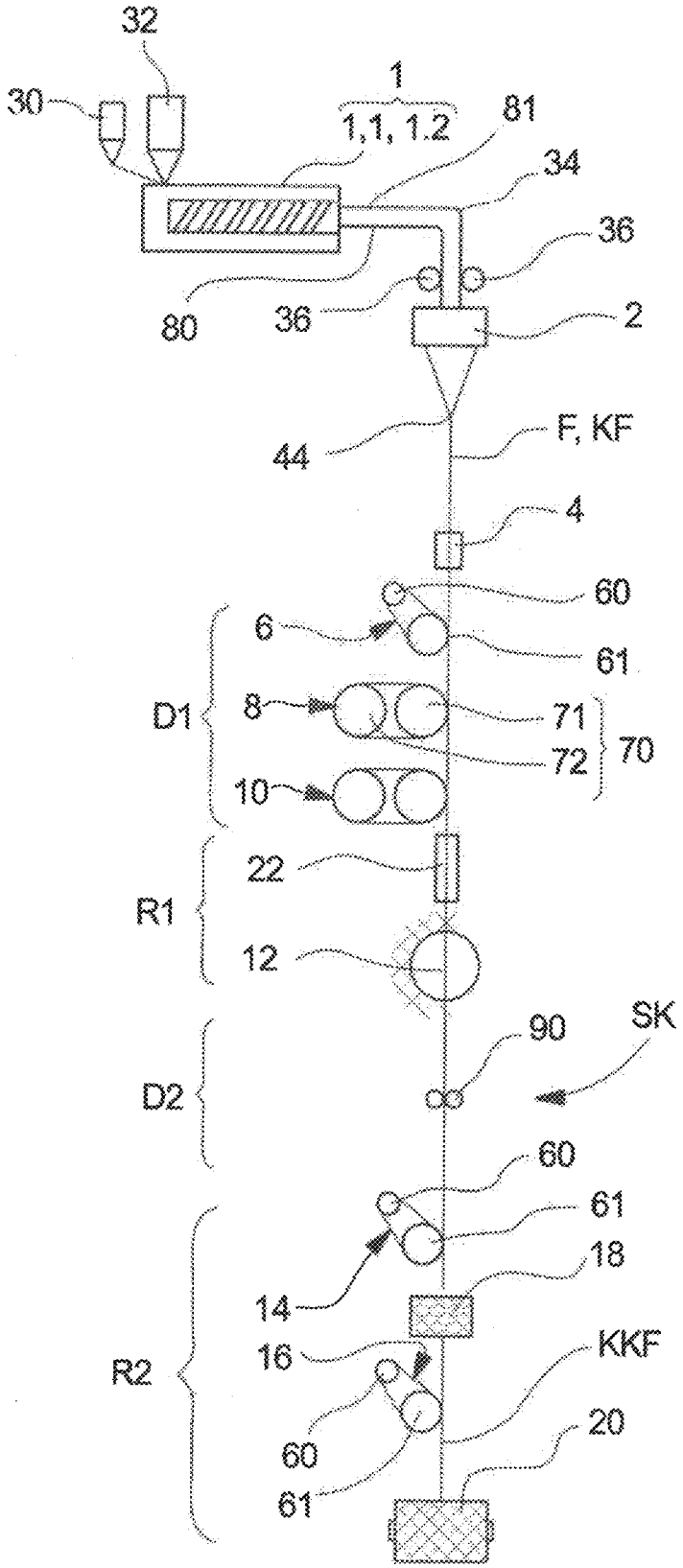
Figure 6:
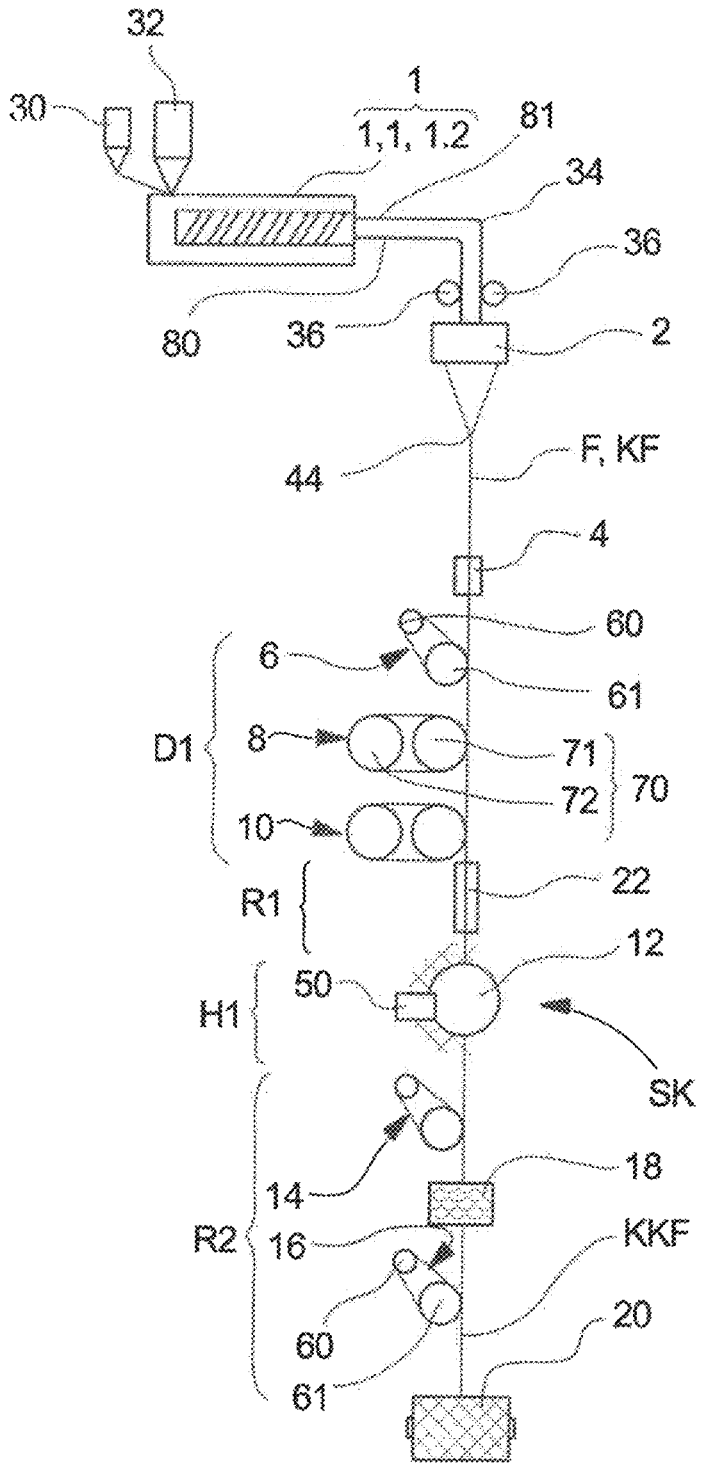
Figure 7:
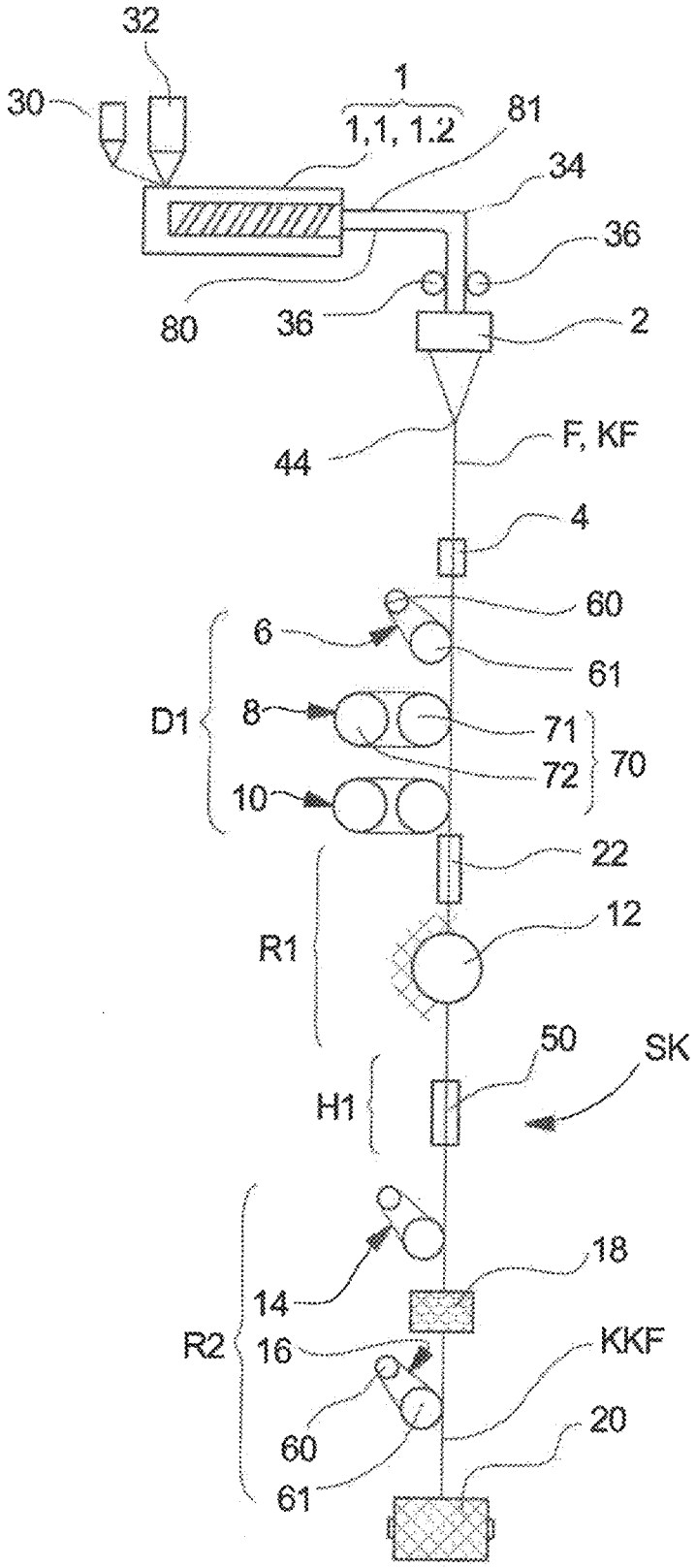
Figure 8:
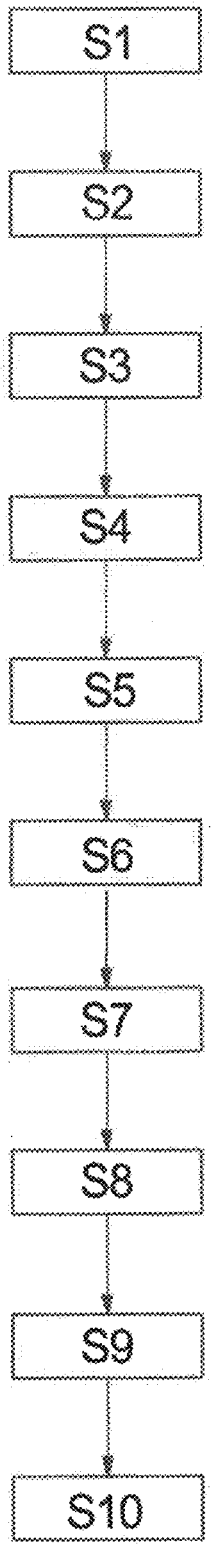

In the figures:

FIG. 1 schematically shows a device for producing a crimped composite thread without actively initiated self-crimping;

FIG. 2 schematically shows a first exemplary embodiment of a device and of a method for producing a crimped composite thread, having actively mechanically initiated self-crimping by means of an additional drafting unit which causes mechanical drafting on the composite thread;

FIG. 3 schematically shows a second exemplary embodiment of the device and of the method for producing a crimped composite thread, having actively mechanically initiated self-crimping by means of an additional godet pair which is positioned in front of a cooling drum and causes mechanical drafting on the composite thread;

FIG. 4 schematically shows a third exemplary embodiment of the device and of the method for producing a crimped composite thread, having actively mechanically initiated self-crimping by means of an additional godet pair which is positioned after the cooling drum and causes mechanical drafting on the composite thread;

FIG. 5 schematically shows a fourth exemplary embodiment of the device and of the method for producing a crimped composite thread, having actively mechanically initiated self-crimping by means of a thread brake which is positioned after the cooling drum and causes mechanical drafting on the composite thread;

FIG. 6 schematically shows a fifth exemplary embodiment of the device and of the method for producing a crimped composite thread, having actively thermally initiated self-crimping by means of a heating installation which is positioned at the cooling drum and causes a thermal treatment on the composite thread;

FIG. 7 schematically shows a sixth exemplary embodiment of the device and of the method for producing a crimped composite thread, having actively thermally initiated self-crimping by means of a heating installation which is positioned after the cooling drum and causes a thermal treatment on the composite thread; and FIG. 8 schematically shows a block diagram of the method steps for producing a crimped composite thread, wherein self-crimping of the composite thread is initiated mechanically or thermally, or mechanically and thermally, by means of an active crimping initiation.

FIG. 1 shows a device for producing a crimped composite thread KKF, without actively initiated self-crimping.

The composite thread KF is usually spun from at least a first polymer melt 80 and a second polymer melt 81 next to one another by means of a melt-spinning device 2, so that the composite thread KF is formed with at least two portions.

Thereafter, drafting takes place in a drafting step D1 in which orienting the previously randomly arranged chain molecules so as to form oriented chain molecules is performed.

Mechanically applied crimping can then be caused by means of a compression-texturising installation 22, in that the composite thread KF is compressed in a compression chamber of the compression-texturising installation 22 in such a way that a loop yarn is created, whereby the filaments of the composite thread KF are kinked, this causing texturising, or crimping, of the composite thread KF.

The composite thread KF can thereafter be deposited onto a cooling drum 12, or cooling roller 12, so that the internal temperature of the composite thread KF is below the glass transition temperature and the texturising previously generated, hereunder also referred to as crimping, is set.

In the device having the compression-texturising installation 22 shown in FIG. 1, the crimping is formed in step T1, whereby the composite thread KF is compressed so as to form a plug in the compression-texturising installation 22, this leading to crimping of the composite thread KF.

The device shown in FIG. 1 has a first polymer store 30 in which plastics material chips of a first polymer 80 are stored, and a second polymer store 32 in which plastics material chips of a second polymer 81 are stored.

The two, or the plurality of, polymers can be of the same polymer type (e.g. two PETs with different proportions of IV and/or $TiO_2$), or be different polymer types (e.g. PET and PTT). The polymer combination of the composite thread KF is chosen in such a way that self-crimping of the composite thread KF can be initiated by introducing tensile stress and/or temperature into the composite thread KF.

The plastics material chips of the first and of the second polymer store 30, 32 are in each case separately processed in a first extruder 1.1 and a second extruder 1.2 so as to form a first and a second polymer melt 80, 81, and are supplied by way of a separate melt line 34 to a melt-spinning device 2 by means of a first and a second melt pump 36, 36.

The first and the second polymer melt are arranged next to one another, in particular side-by-side, in portions above capillaries so as to form a thread in such a way that a composite thread KF is formed. The composite threads can be combined at a convergence point 44 so as to form a thread F.

After the convergence point 44, the composite thread KF is preferably guided over a preparation installation 4 and provided with a preparation agent. The preparation agent minimises friction, ensures static discharging, and facilitates transportation of the composite thread KF.

The thread running direction F runs from the melt-spinning installation 2 towards a take-up winding device 20.

In a first drafting zone D1, or in a first drafting step D1, the composite threads KF are drawn from the melt-spinning installation 2 by means of an inlet unit 6 having an idler roller 60 and a godet 61, and are drafted by a first drafting unit 8 and a second drafting unit 10, each consisting of one godet pair.

After the drafting step D1, in a texturising step T1, the composite thread is compressed in a compression-texturising installation 22, as a result of which the composite thread KF is crimped by compression.

After the texturising step T1, the composite thread KF is guided over a cooling drum 12, whereby the composite thread KF is cooled to a predetermined temperature in a cooling zone C1.

After the cooling step in the cooling zone C1, relaxing takes place in a relaxing zone R1. In the process, the crimped composite thread KKF is also interlaced by means of an interlacing installation 18 in such a way that entanglement knots are formed in the crimped composite thread KKF, so that the crimped composite threads KKF remain permanently combined and held so as to form an overall thread.

The relaxing zone R1 has a first relaxing unit 14 and a second relaxing unit 16. The interlacing installation 18 is preferably positioned between the first relaxing unit 14 and the second relaxing unit 16.

The drafted, texturised and relaxed overall thread is thereafter wound in a take-up winding device 20 so as to form a package for further processing such as, for example, to form a carpet.

Exemplary embodiments of the device according to the invention and of the method according to the invention for producing a crimped composite thread KKF with actively initiated self-crimping SK are described in FIGS. 2 to 8 hereunder. The features that are relevant for the actively initiated self-crimping SK are in particular described in the description hereunder.

The crimped composite thread KKF of the exemplary embodiments described in FIGS. 2 to 8 has a proportion of crimping by self-crimping SK, and a proportion of crimping by compression-texturising T1. The proportion of crimping by self-crimping SK is better in terms of quality than the proportion of crimping by compression-texturising T1.

The features described in FIG. 1 with the same reference signs are also identical in the device according to the invention and in the method according to the invention from FIGS. 2 to 7.

However, not all features of the exemplary embodiments shown in FIGS. 2 to 8 are required.

Described in FIGS. 2 to 8 are exemplary embodiments in which the overall crimping of the crimped composite thread KKF includes both compression-crimping T1, formed by the compression-texturising installation 22, as well as actively mechanically or thermally initiated self-crimping SK.

The mechanically actively initiated self-crimping SK is initiated by means of tensile stress with a predetermined variable, which is applied to the composite thread KF by means of additional godets, this being indicated by the reference sign SK which indicates the position of the mechanical active initiation of self-crimping SK in the respective exemplary embodiments of the device, or in the respective exemplary embodiments of the method, in FIGS. 2 to 5. The variable of the tensile stress can determine the degree of self-crimping SK.

The thermally actively initiated self-crimping is initiated by an additional heating installation 50 which acts on the composite thread KF, this being indicated by the reference sign SK which indicates the position of the thermal initiation of self-crimping SK in the respective exemplary embodiments of the device, or in the respective exemplary embodiments of the method, in FIGS. 6 to 7. The variable of the temperature can determine the degree of self-crimping SK.

Self-crimping SK of the composite thread KF can advantageously be initiated at any arbitrary position within the production process, or within the device of FIGS. 2 to 7, depending on where the mechanical and/or thermal activation of self-crimping SK is carried out in the succession of the respective steps.

In other words, self-crimping SK can be initiated by mechanical and/or thermal activation at a predetermined position with the device. The initiation of self-crimping SK can take place with mechanical and/or thermal means, also by means of the compression-texturising installation 22 as illustrated in the exemplary embodiments in FIGS. 2 to 7. There is no separate compression-texturising T1 by the compression-texturising installation 22 in the process. The compression-texturising installation 22 may also be omitted.

The invention comprises a method and a device for producing a very intensely self-crimping composite thread KF from at least two, or a plurality of, polymers 80, 81. The activatable self-crimping SK of the composite thread KF improves the quality of crimping. Moreover, polymer melt 80, 81 can be effectively saved in the process, as a result of which a composite thread KKF with improved crimping quality can be produced with less material.

Particularly effective crimping of the composite thread KF is possible by means of the devices described hereunder, whereby a smaller quantity of the respective polymer melt is simultaneously required in the process.

FIG. 2 shows a first exemplary embodiment of the method and of the device for producing a crimped composite thread KKF which by means of active crimping initiation is animated to self-crimping SK its composite thread KF.

The components and features with the identical reference signs from FIG. 1 correspond to the components and features of the exemplary embodiments of the device and of the method for producing a crimped composite thread KKF described in FIGS. 2 to 7 hereunder, whereby the crimped composite thread KKF had actively activatable self-crimping SK.

The features and devices of the method according to the invention and of the device according to the invention are described in particular hereunder, said features and devices potentially also being part of the device of FIG. 1 and having new features and components of the installations for initiating the actively activatable self-crimping SK.

The method shown in FIG. 2, and the device shown, additionally has a second drafting zone D2 for initiating self-crimping SK. The drafting zone D2 additionally has a third drafting unit 40 which has an idler roller 60 and a godet 61, like the inlet unit 6 which only draws the composite thread KF from the melt-spinning device 2 in the thread running direction F.

A further embodiment is shown drawn with dashed lines in FIG. 2, whereby the second drafting zone has a third and a fourth drafting unit 40.1 and 40.2.

The third, and the fourth, drafting unit 40.1, 40.2 are adjusted in such a manner that a predetermined tensile stress acts on the composite thread KF, said tensile stress causing corresponding self-crimping SK of the composite thread KF.

In order for the self-crimping property to be effective, a first polymer melt 80 and a second polymer melt 81 with different viscosities are in each case supplied at different flow rates to the melt-spinning installation 2 by way of the first and the second extruder 1.1 and 1.2 and the associated melt lines 34, said melt-spinning installation 2 by way of its capillaries and spinning nozzles then generating a side-by-side composite thread KF which has the properties of activatable self-crimping SK.

FIG. 3 schematically shows a second exemplary embodiment of the device and of the method for producing a crimped composite thread KKF with actively mechanically initiated self-crimping SK by means of an additional godet pair 42 positioned in front of the cooling drum.

The godet pair 42 is able to be assigned to a third drafting unit 42, and has a first and a second godet 71, 72. The third drafting unit 42 is positioned in a second drafting zone D2 for carrying out a second drafting step D2, which causes additional mechanical drafting on the composite thread KF and leads to self-crimping SK being initiated.

The crimped composite thread KKF in the thread running direction F in the relaxing zone R1 is thereafter additionally compression-crimped T1 in the compression-texturising installation 22, and thereafter cooled in a cooling step C1 at the cooling drum 12.

In further steps, the self-crimped and the compression-crimped composite thread KKF is relaxed in a first relaxing unit 14 and a second relaxing unit 16, and is provided with entanglement knots in an interlacing installation 18. The interlacing installation 18 is positioned between the first and the second relaxing unit 14, 16.

The first relaxing unit 14 and the second relaxing unit 16 each have an idler roller 60 and a godet 61.

The godets 71, 72, 61 can be heated and/or not heated. In this way, further temperature-controlling is possible in the method and can be closed-loop controlled so as to correspond to the polymers used and preferably be performed according to the degree of crimping, right down to room temperature.

Initiating self-crimping SK in the composite thread KF at the respective position can optionally also be activated and initiated by way of the heated godets 71, 72 and 61.

The activated self-crimping SK by mechanical drafting can be provided with associated sensors which detect the tensile stress introduced into the composite thread KF and the initiated self-crimping SK in such a way that it is possible to closed-loop control self-crimping and the degree of self-crimping SK.

FIG. 4 schematically shows a third exemplary embodiment of the device and of the method for producing a crimped composite thread KKF with actively mechanically initiated self-crimping SK by means of an additional godet pair 42.1, or 42.2, which is positioned after the cooling drum 12 and causes mechanical drafting on the composite thread KF. The additional godet pair 42.1, or 42.2, defines a second drafting zone D2. The drafting zone D2 may also have only one godet pair 42.1.

The godet pair 42.1, illustrated by dashed lines, is optional.

The respective godet pair 42.1, or 42.2, can also be heated so that thermal activation of self-crimping SK of the composite thread KF is also possible besides the mechanical activation of self-crimping SK.

The second drafting zone D2 subdivides the relaxing zone R into a first relaxing zone R1 and into a second relaxing zone R2.

The first relaxing zone R1 has the compression-texturising installation 22 and the cooling drum 12, which are disposed behind one another in the thread running direction F.

The first relaxing zone R2 has the first relaxing unit 14 and the second relaxing unit 16 and the interlacing installation 18. The interlacing installation 18 in the thread running direction F is positioned between the first relaxing unit 14 and the second relaxing unit 18.

FIG. 5 schematically shows a fourth exemplary embodiment of the device and of the method for producing a crimped composite thread KKF with actively mechanically initiated self-crimping SK by means of a thread brake 90 which is positioned after the cooling drum 12 in the thread running direction F and causes mechanical drafting on the composite thread KF, thus activating and initiating self-crimping SK.

The exemplary embodiment shown in FIG. 5 is identical to the exemplary embodiment shown in FIG. 4, with the exception that a thread brake 90 for initiating mechanical self-crimping SK is provided instead of the godet pair 42.1, or 42.2, in the second drafting zone D2.

FIG. 6 schematically shows a fifth exemplary embodiment of the device and of the method for producing a crimped composite thread KKF with actively thermally initiated self-crimping SK by means of a heating installation 50 which is positioned at the cooling drum 12 and causes a thermal treatment on the composite thread KF.

The heating installation 50 incorporates into the composite thread a predetermined temperature in the range from 100 to 150° C., which causes initiation of self-crimping SK. The variable of the incorporated temperature can also determine the degree of self-crimping SK. The heating installation 50 can be provided with associated sensors which detect the temperature incorporated into the composite thread KF and the initiated self-crimping SK in such a way that it is possible to closed-loop control self-crimping and the degree of self-crimping SK.

FIG. 7 schematically shows a sixth exemplary embodiment of the device and of the method for producing a crimped composite thread KKF with actively thermally initiated self-crimping SK by means of a heating installation 50 which in the thread running direction F is positioned after the cooling drum 12 and causes a thermal treatment on the composite thread KF.

The heating installation 50 can be provided with associated sensors which detect the temperature incorporated into the composite thread KF and the initiated self-crimping SK in such a way that it is possible to closed-loop control self-crimping and the degree of self-crimping SK.

The exemplary embodiments shown in FIGS. 6 and 7 are identical to the exemplary embodiment shown in FIG. 4, with the exception that a heating zone H1 for initiating self-crimping SK is provided instead of the second drafting zone D2.

The exemplary embodiments proposed here, and the drafting zones D2 and heating zones H1 shown therein for initiating self-crimping SK, can also be combined with one another. In this way, the method and the device may also have a drafting zone D2 and a heating zone H1.

FIG. 8 schematically shows a block diagram of the method steps for producing a crimped composite thread KKF, whereby self-crimping SK of the composite thread KF is initiated mechanically or thermally, and/or mechanically and thermally, by means of active crimping initiation.

In a particularly preferred exemplary embodiment of the method, the first polymer melt 80 and the second polymer melt 81 are extruded in the melt-spinning device 2 in step S1, and in step S2 spun so as to form a plurality of composite filaments.

The number of capillaries in the melt-spinning device 2 determines the number of composite filaments.

In step S3, the plurality of composite filaments are cooled so as to form a partially crystalline structure. Cooling can be carried out by transverse and/or radial cooling in suitably specified cooling ducts, with air guided transversely to and/or in the thread running direction F.

In step S4, the plurality of composite filaments are combined at the convergence point 44 so as to form a composite thread KF.

In step S5, the combined composite thread KF is provided with a preparation oil in a preparation installation 4, which improves friction and processing of the composite thread KF and prevents, or at least minimises, static charging of the composite thread KF.

In a first drafting step D1, preliminary drafting of the composite thread KF by the first drafting device 6, 8, 10 takes place in step S6.

After drafting, compression-texturising, or compression-crimping T1, by the compression-texturising installation 22 can take place in step S7. In the process, the composite thread KF is crimped by compression T1 and compressed so as to form a plug.

In step S8, the plug is cooled on the cooling drum 12 in a cooling step C1.

In step S9, the plug is drafted and relaxed in a relaxing step R1 so as form a composite thread KF that is able to be entangled, and provided with entanglement knots which combine and hold together the filaments of the crimped composite thread KKF for further processing.

Finally, the relaxed and entangled composite thread KKF is wound so as to form a wound package by means of a take-up winding device 20 in step S10.

The activation of self-crimping SK by applying a predetermined mechanical tensile stress variable in a second drafting step D2, and/or by applying a predetermined temperature variable in a heating step H1, preferably takes place before, during and/or after cooling step C1.

Shown in FIGS. 2, 4 and 5 are exemplary embodiments in which, in addition to compression-crimping T1, self-crimping SK of the composite thread KF is activated and initiated by a suitable drafting device 40.2, 42.1, 42.2 in a second drafting step D2 on account of an applied tensile stress variable in the composite thread KF, once the composite thread KF has been cooled on the cooling drum 12 in cooling step C1.

Shown in FIG. 3 is an exemplary embodiment in which, in addition to compression-crimping, self-crimping SK of the composite thread KF is activated and initiated by suitable drafting devices 42 in a second drafting step D2 on account of an applied tensile stress variable in the composite thread KF, before the composite thread is cooled on the cooling drum 12 in cooling step C1.

In the exemplary embodiment shown in FIG. 3, compression-crimping T1 additionally takes place by means of the compression-texturising installation 22 before cooling step C1 but after self-crimping SK.

Shown in FIGS. 6 and 7 are exemplary embodiments in which initiating self-crimping SK is thermally caused in cooling step C1 at the cooling drum 12, and/or after cooling step C1 at the cooling drum 12, by means of heating H1, whereby a predetermined temperature variable is applied to the composite thread by the heating installation 50 which is additionally positioned in the thread run.

Self-crimping SK can also be initiated and activated at other positions of the device in the thread running direction F, and in other method steps in the production method.

In an exemplary embodiment not illustrated, the activation of self-crimping SK is only mechanical or thermal, or mechanical and thermal, and no compression-crimping is necessary.

LIST OF REFERENCE SIGNS

1 Extruder
1.1 First extruder
1.2 Second extruder
2 Melt-spinning device
4 Preparation installation
6 Inlet unit
8
00 First drafting unit
10 Second drafting unit
12 Cooling drum
14 First relaxation unit
16 Second relaxation unit
18 Interlacing installation
20 Take-up winding device
22 Compression-texturising installation
30 First polymer store
32 Second polymer store
34 Melt line
36, 36 First melt pump, second melt pump
40, 40.1 Third drafting unit
40.2 Fourth drafting unit
42 Third drafting unit
42.1 Third drafting unit
42.2 Fourth drafting unit
44 Convergence point
50 Heating installation
60 Idler roller
61 Godet
70 Godet pair
71, 72 First godet, second godet
80, 81 First polymer melt, second polymer melt
90 Thread brake
C1 Cooling zone/cooling step
D1 First drafting zone/first drafting step
D2 Second drafting zone/second drafting step
R1 First relaxing zone/first relaxing step
R2 Second relaxing zone/second relaxing step
F Thread running direction
KF Composite thread, bi-component thread
KKF Crimped composite thread
SK Self-crimping position/self-crimping step
T1 Compression-crimping
H1 Heating zone, heating step

The invention claimed is:

1. Method for producing a crimped composite thread, wherein the crimped composite thread has a plurality of composite filaments from a first polymer melt and a second polymer melt, wherein the first and the second polymer melt are arranged next to one another, side-by-side, in portions in such a way that a composite thread is formed, wherein the first polymer melt and the second polymer melt each have a different material property so that self-crimping of the composite thread is initiated open-loop and/or closed-loop controlled by an active crimping initiation at a predetermined point in the method, and wherein the composite thread is configured to be trilobal in shape.

2. Method according to claim 1, wherein the active crimping initiation of self-crimping is mechanically initiated by applying a predetermined tension variable to the composite thread, wherein a predetermined tensile stress is applied to the composite thread.

3. Method according to claim 1, wherein the active crimping initiation of self-crimping is thermally initiated by heating, wherein a predetermined temperature variable is applied to the composite thread.

4. Method according to claim 1, wherein each trilobal portion has in each case a first, a second and/or a third polymer melt.

5. Method according to claim 1, wherein the first polymer melt has a different viscosity than the second polymer melt.

6. Method according to claim 1, wherein a tensile stress on the composite thread is initiated by means of a drafting unit, wherein the tensile stress is in the range from 1 to 4.5 cN/dtex, which reaches a predetermined threshold value that initiates self-crimping is applied to the composite thread by means of the drafting unit, wherein the variable of the threshold value determines the degree of self-crimping.

7. Method according to claim 1, wherein a tensile stress which, for initiating self-crimping, is applied to the composite thread by means of a drafting unit is greater than a tension which is applied to the composite thread for drafting by a drafting unit.

8. Method according to claim 1, wherein self-crimping of the composite thread is initiated by means of heating by means of a heating installation, wherein self-crimping is initiated at a predetermined temperature variable in the composite thread, at a temperature variable in the range from 100 to 150° C., wherein the variable of the temperature determines the degree of self-crimping.

9. Method according to claim 1, wherein the first polymer melt and the second polymer melt are extruded in a melt-spinning device and spun so as to form a plurality of composite filaments which are cooled so as to form a partially crystalline structure and are converged at a convergence point so as to form a composite thread which is drafted in a first drafting device so as to form a preliminary drafted composite thread, wherein self-crimping in the composite thread is initiated in subsequent steps by applying a predetermined tension variable and/or a predetermined temperature variable so that a crimped composite thread is formed.

10. Method according to claim 1, wherein the active crimping initiation of self-crimping of the composite thread is initiated before and/or after compression-crimping, wherein the composite thread during compression-crimping is compressed in a thread running direction in a compression-crimping installation, wherein the compression of the composite thread initiates crimping.

11. Device for producing a crimped composite thread, which is specified for carrying out a method for producing the crimped composite thread, in which the crimped composite thread has a plurality of composite filaments from a first polymer melt and a second polymer melt, wherein the first and the second polymer melt are arranged next to one another, side-by-side, in portions in such a way that a composite thread is formed, wherein the first polymer melt and the second polymer melt each have a different material property so that self-crimping of the composite thread is initiated open-loop and/or closed-loop controlled by an active crimping initiation at a predetermined point in the method, and wherein the device has an installation for the active initiation of self-crimping of the composite thread, and wherein the composite thread is configured to be trilobal in shape.

12. Device according to claim 11, wherein the installation for the active initiation of self-crimping has a drafting device for generating tensile stress in the composite thread, and/or has a heating installation for generating an increase in temperature in the composite thread.

13. System for producing a crimped composite thread from a bulk continuous filament yarn for carpet yarn, which is specified for carrying out a method for producing the crimped composite thread, in which the crimped composite thread has a plurality of composite filaments from a first polymer melt and a second polymer melt, wherein the first and the second polymer melt are arranged next to one another, side-by-side, in portions in such a way that a composite thread is formed, wherein the first polymer melt and the second polymer melt each have a different material property so that self-crimping of the composite thread is initiated open-loop and/or closed-loop controlled by an active crimping initiation at a predetermined point in the method, and wherein the composite thread is configured to be trilobal in shape.

14. System as in claim 13 wherein the device has an installation for the active initiation of self-crimping of the composite thread.

15. System as in claim 14 wherein the installation for the active initiation of self-crimping has a drafting device for generating tensile stress in the composite thread, and/or has a heating installation for generating an increase in temperature in the composite thread.

* * * * *